US011140931B1

(12) United States Patent
Stewart

(10) Patent No.: US 11,140,931 B1
(45) Date of Patent: Oct. 12, 2021

(54) SWEATSHIRT WITH CARGO CARRYING ACCESSORIES

(71) Applicant: Jason Stewart, Coatesville, PA (US)

(72) Inventor: Jason Stewart, Coatesville, PA (US)

( * ) Notice: Subject to any disclaimer, the term of this patent is extended or adjusted under 35 U.S.C. 154(b) by 465 days.

(21) Appl. No.: 16/121,951

(22) Filed: Sep. 5, 2018

Related U.S. Application Data

(60) Provisional application No. 62/555,179, filed on Sep. 7, 2017.

(51) Int. Cl.
*A41D 27/20* (2006.01)
*A41D 3/00* (2006.01)

(52) U.S. Cl.
CPC ..... *A41D 27/201* (2013.01); *A41D 3/005* (2013.01); *A41D 2200/20* (2013.01); *A41D 2300/322* (2013.01)

(58) Field of Classification Search
CPC .. A41D 27/201; A41D 3/005; A41D 2200/20; A41D 2300/322; A41D 27/205
See application file for complete search history.

(56) References Cited

U.S. PATENT DOCUMENTS 2,970,316 A * 2/1961 Silin ..... A45F 3/042 2/94
5,195,187 A 3/1993 Yang
5,509,147 A 4/1996 Busquets
5,718,000 A 2/1998 Ost et al.
5,784,719 A 7/1998 Robinson
5,987,644 A 11/1999 Mengato
7,000,255 B1 2/2006 Baacke
8,234,720 B2 8/2012 Freedman et al.
9,271,533 B2 3/2016 Kochling
9,445,637 B2 9/2016 Buczowski et al.
9,931,545 B1 * 4/2018 Calcaterra ..... A63B 47/001
2007/0000030 A1 1/2007 Toomey
2009/0000203 A1 * 1/2009 Kirejczyk ..... B60J 5/0416 49/352
2011/0233242 A1 9/2011 Broudy
2012/0030864 A1 2/2012 Marois et al.
2013/0152269 A1 6/2013 Coward
2017/0055612 A1 * 3/2017 Francis, II ..... A41B 13/005
2017/0245567 A1 * 8/2017 Fathollahi ..... H02J 7/342
2019/0104775 A1 * 4/2019 Wood ..... A41D 13/11

OTHER PUBLICATIONS

D-Town 5 Pocket Utility Dog Training Sweatshirt. 3 pages. 2017.
SCOTTeVEST Hoodie Cotton—10 Pockets—Comfortable Travel Clothing. 7 pages. 2017.

* cited by examiner

*Primary Examiner* — Richale L Quinn
(74) *Attorney, Agent, or Firm* — Joseph E. Maenner; Petock & Petock LLC

(57) ABSTRACT

A cargo-carrying sweatshirt includes a front panel, a rear panel, a left panel connecting the front panel and the rear panel wherein the left panel has a left sleeve, and a right panel connecting the front panel and the rear panel wherein the right panel has a right sleeve. A head opening is provided at a top portion of the sweatshirt and defined by the front panel and the rear panel. A body opening is provided at a bottom portion of the sweatshirt and is defined by the front panel, the rear panel, the left panel, and the right panel. The sweatshirt includes a plurality of cargo carrying accessories on the front panel, the rear panel, and the sleeves.

12 Claims, 7 Drawing Sheets

SWEATSHIRT WITH CARGO CARRYING ACCESSORIES

CROSS-REFERENCE TO RELATED APPLICATION

The present application claims priority from U.S. Provisional Patent Application Ser. No. 62/555,179, filed on Sep. 7, 2017, which is incorporated herein by reference in its entirety.

BACKGROUND OF THE INVENTION

Field of the Invention

The present invention relates to a sweatshirt with accessories that allow the wearer to carry cargo thereon and in.

Description of the Related Art

Sweatshirts are worn over a wearer's torso to keep the wearer warm in cool weather. Many sweatshirts include pockets to carry cargo or to allow the wearer to insert his hands into in order to keep the hands warm. It would be beneficial to provide a sweatshirt with additional features to allow the wearer to carry more and different types of items on or in the sweatshirt.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a cargo-carrying sweatshirt having a front panel, a rear panel, a left panel connecting the front panel and the rear panel wherein the left panel has a left sleeve, and a right panel connecting the front panel and the rear panel wherein the right panel has a right sleeve. A head opening is provided at a top portion of the sweatshirt and defined by the front panel and the rear panel. A body opening is provided at a bottom portion of the sweatshirt and is defined by the front panel, the rear panel, the left panel, and the right panel. The sweatshirt includes a plurality of cargo carrying accessories on the front panel, the rear panel, the sleeves, the head opening, and the body opening.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
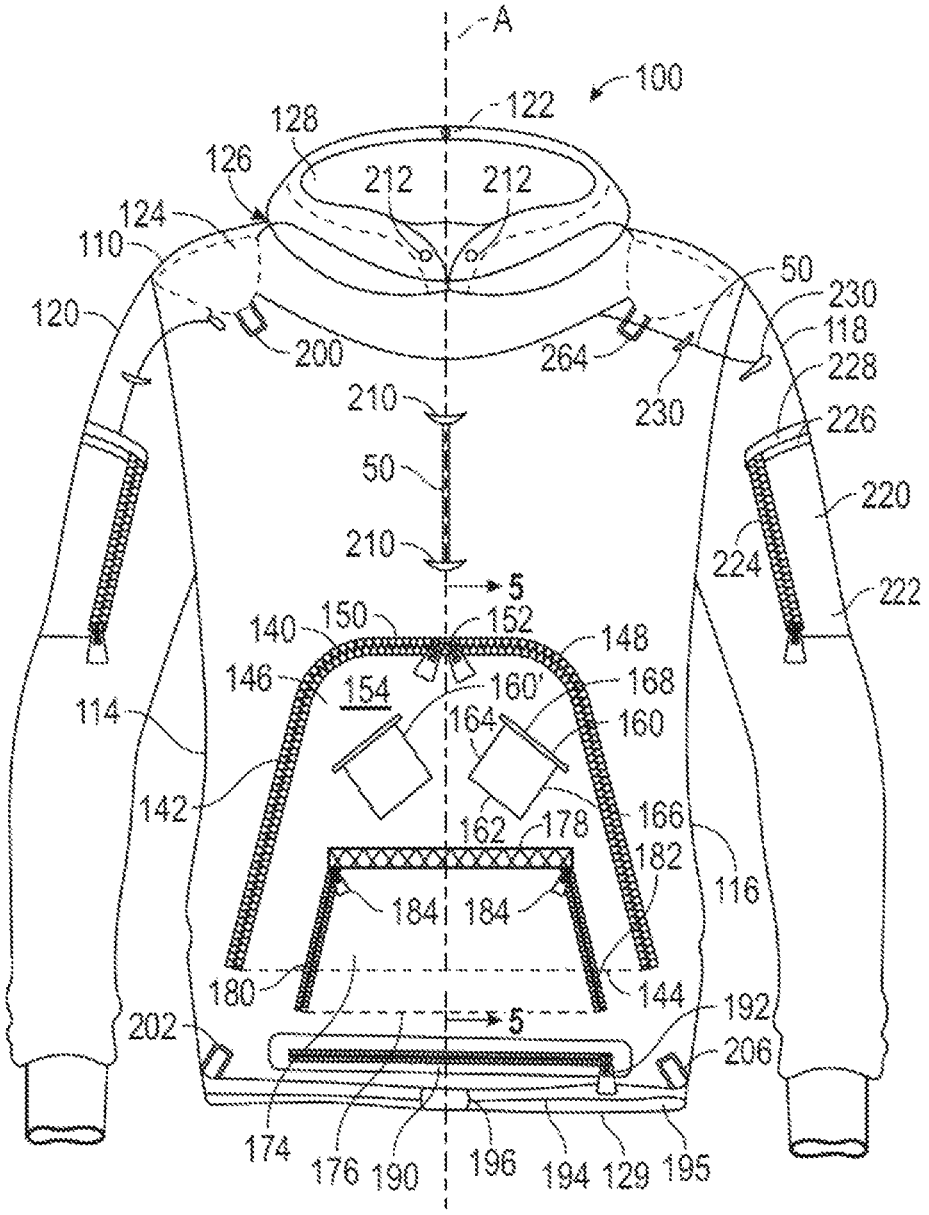
FIG. 1 is a front elevational view of a cargo carrying sweatshirt according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Referring to the Figures, a cargo carrying sweatshirt 100 ("sweatshirt 100") according to a first exemplary embodiment of the present invention is shown. Sweatshirt 100 can be used to carry cargo thereon and therein via a plurality of pockets and accessories, as will be described in detail herein. While a sweatshirt is shown and described, those skilled in the art will recognize that other types of apparel can be used within the scope of this invention.

Figure 2:
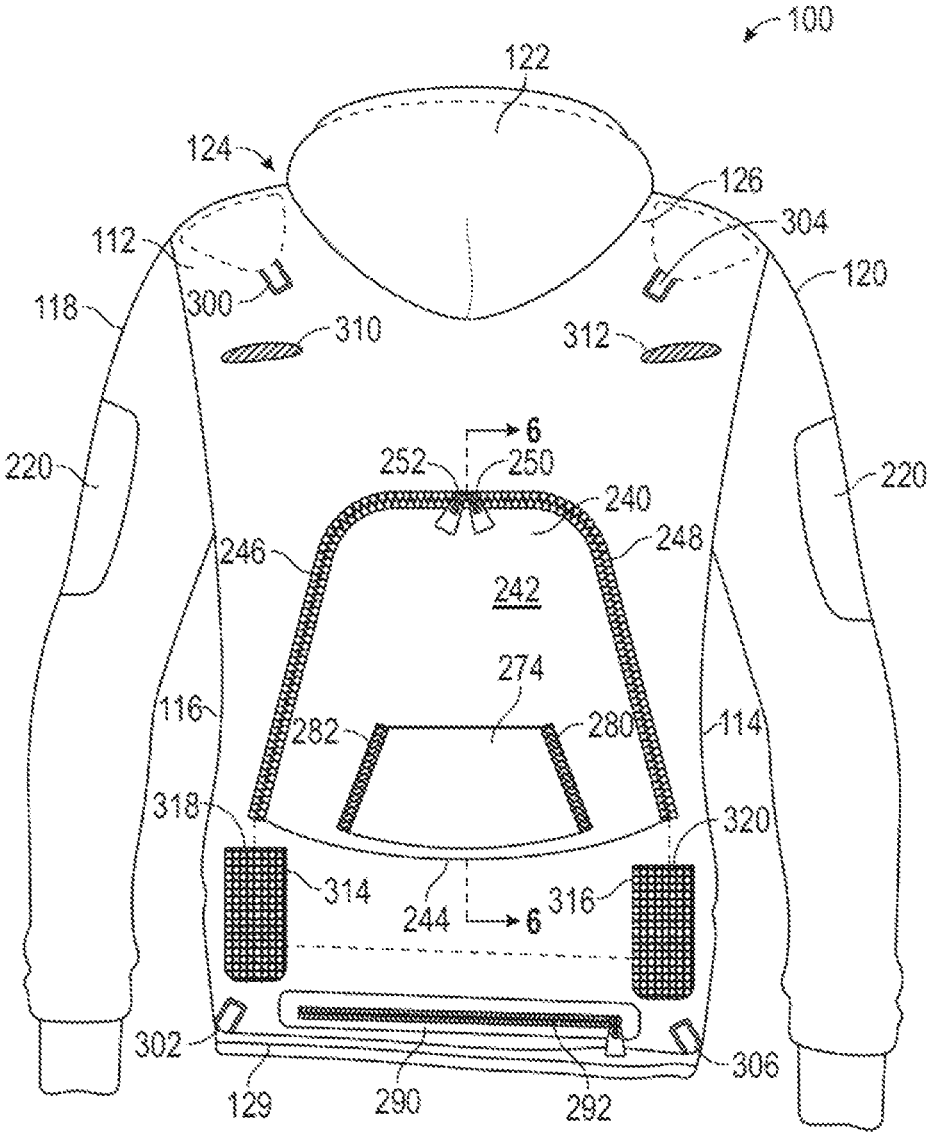
FIG. 2 is a rear elevational view of the cargo carrying sweatshirt shown in FIG. 1.
Figure 4:
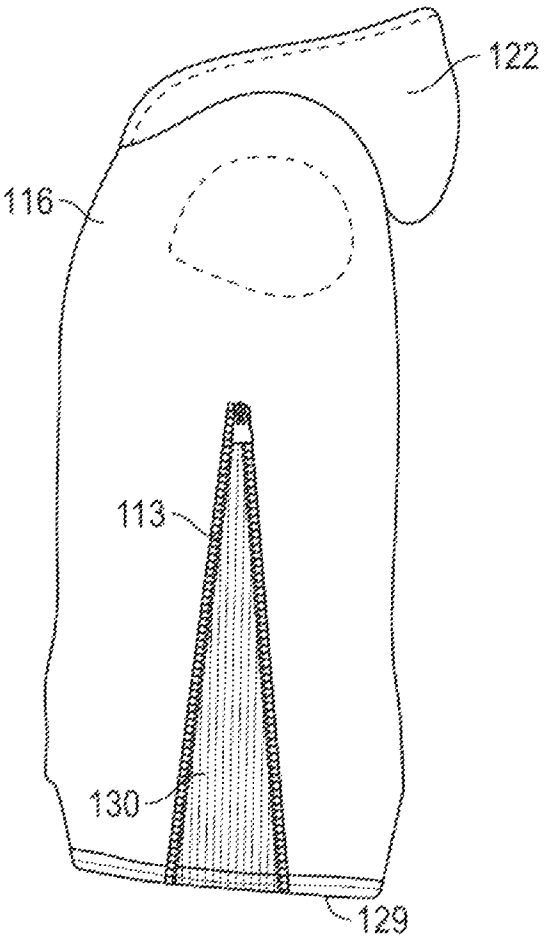
FIG. 4 is a left side elevational view of the cargo carrying sweatshirt shown in FIG. 1, with the left sleeve removed for clarity.
Figure 3:
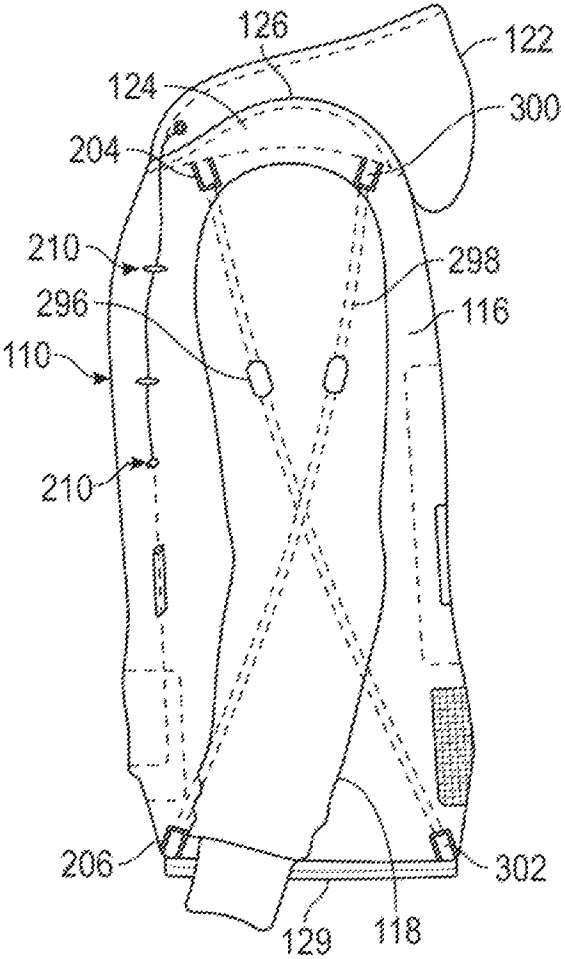
FIG. 3 is a left side elevational view of the cargo carrying sweatshirt shown in FIG. 1.

Sweatshirt 100 includes a front panel 110 (shown in FIG. 1), a rear panel 112 (shown in FIG. 2) and right and left side panels 114, 116 connecting front panel 110 and rear panel 112 to each other. FIG. 3 shows left side panel 116 with left sleeve 118, while FIG. 4 shows left side panel 116 with left sleeve 118 removed for clarity. As shown in FIGS. 1 and 2, right sleeve 120 extends from right side panel 114.

Optionally, a hood 122 can extend upwardly from the top of sweatshirt 100, although those skilled in the art will recognize that hood 122 can be omitted entirely. A neck/shoulder area 124 can include a reinforcement or stabilizer material 126 that extends 360 degrees around a head opening 128 that is defined by front panel 110 and rear panel 112. A body opening 129 extends at a bottom portion of sweatshirt 100 and is defined by front panel 110, rear panel 112, right panel 114, and left panel 116. Referring to FIG. 1, a longitudinal axis "A" extends through sweatshirt 100 between head opening 128 and body opening 129. Additionally, referring to FIG. 4, either or both of right side panel 114 and left side panel 116 can include a stretchable portion 130 to allow sweatshirt 100 to expand to accommodate the wearer. Optionally, a zipper 113 can be attached along the length of stretchable portion 130 so that stretchable portion 130 can be opened (zipper up) or closed (zipper down).

Sweatshirt 100 includes a plurality of accessories that allow the wearer to carry cargo in or on sweatshirt 100. While the listing of cargo carrying accessories below is not inclusive, sweatshirt 100 does not necessarily need to incorporate all of the accessories listed.

A front pocket assembly 140 is provided on front panel 110. Front pocket assembly 140 includes an upper pocket 142 having a closed bottom 144 and first and second zippered sides 146, 148. A zippered top 150 extends between first and second zippered sides 146, 148. A zipper 152 is operable to open and close any or all of first and second zippered sides 146, 148 and zippered top 150. While two zippers 152 are shown, those skilled in the art will recognize that a single zipper 152 can be used.

Figure 5:
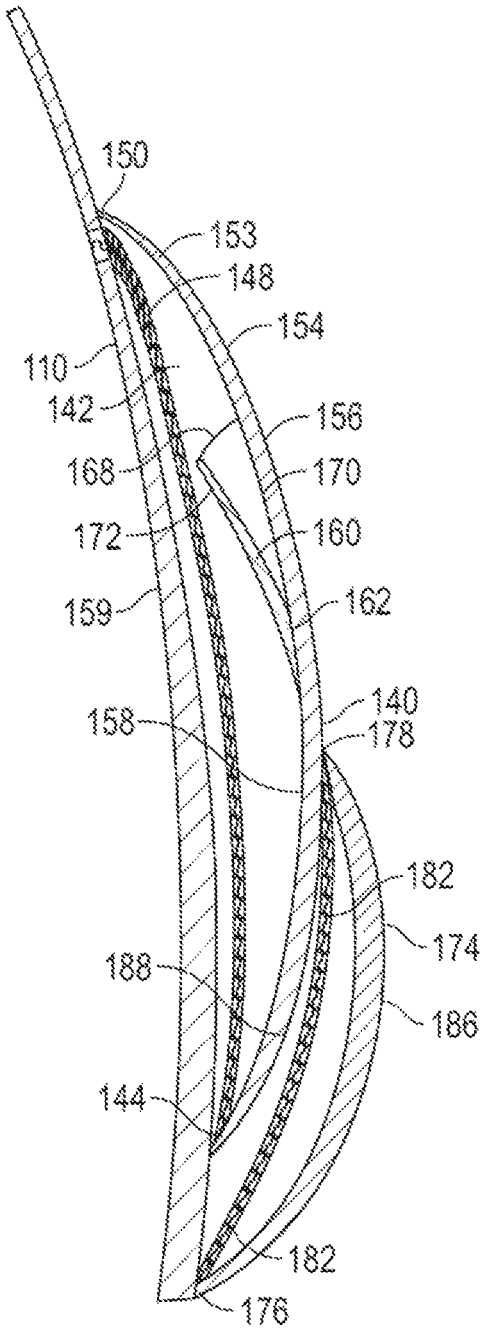
FIG. 5 is a sectional view of a front pocket portion of the sweatshirt of FIG. 1, taken through lines 5-5 of FIG. 1.

Referring to FIGS. 1 and 5, front pocket assembly 140 includes a front panel 154 having an exterior face 156 and an opposing interior face 158. Front panel 154 is defined by closed bottom 144, first and second zippered sides 146, 148, and zippered top 150. A rear panel 159 is defined by closed bottom 144, first and second zippered sides 146, 148, and zippered top 150. Zipper 152 closes all of first and second zippered sides 146, 148 and zippered top 150, forming a closed pouch between front panel 154 and rear panel 156.

Front pocket assembly 140 includes an inner pocket 160 having a closed bottom 162, closed first and second sides 164, 166, and a closable top 168 extending between the first and second closed sides 164 166. Top 168 can be closed with hook and loop fasteners, magnets, snaps, buttons, or any other known closure device.

Inner pocket 160 includes a front panel 170 formed from a portion of interior face 158 of front panel 154 of front pocket assembly 140. Front panel 170 is defined by closed bottom 162, closed first and second sides 164, 166, and closable top 168. A rear panel 172 of inner pocket 160 faces rear panel 159 of front pocket assembly 140. Rear panel 172 is defined by closed bottom 162, closed first and second sides 164, 166, and closable top 168.

Inner pocket 160 extends at a first angle, oblique to and on one side of longitudinal axis A. Optionally, a second inner pocket 160' extends at a second angle, oblique to and on an opposing side of longitudinal axis A.

A lower pocket 174 extends below front pocket assembly 140, with a portion of lower pocket 174 being part of front pocket assembly 140. Lower pocket 174 includes a closed bottom 176 that merges with front panel 110 and a closed top 178 that merges with front panel 154 of front pocket assembly 140. Lower pocket 174 includes a zippered right hand opening 180 and a zippered left hand opening 182. Right and left hand openings 180, 182 each extends between closed bottom 176 and closed top 178. Optionally, right and left hand openings 180, 182 can each have a zipper 184 to alternatively open/close lower pocket 174.

A front panel 186 of lower pocket 174 is defined by closed bottom 176, closed top 178, and right and left hand openings 180, 182, while a rear panel 188 includes a portion of front panel 110 toward the bottom of lower pocket 174 and a portion of front panel 154 of front pocket assembly 140 above the bottom of lower pocket 174.

A cord storage compartment 190 extends across the front of front panel 110 below lower pocket 170. Cord storage compartment 190 includes a zipper 192 to alternatively open/close cord storage compartment 190.

Body opening 129 is hemmed to provide a passage 194 for a drawstring 195 to extend therethrough. Passage 194 includes an opening 196 at front panel 110 to allow drawstring 195 to extend therethrough and to allow the wearer to tighten drawstring 195 in order to tighten body opening 129 around the wearer's waist.

Front panel 110 also includes a plurality of interior stabilizer loops 200, 202, 204, 206. Loop 200 is located at and connected to stabilizer material 126 on the right side of neck/shoulder area 124. Loop 202 is located just above body opening 129 proximate to right side panel 114. A stabilizer cord (not shown) can be secured to loops 200, 202 and tightened/loosened to adjust the load being carried by sweatshirt 100. Similarly, loop 204 is located at and connected to stabilizer material 126 on the left side of neck/shoulder area 124. Loop 206 is located just above body opening 129 proximate to left side panel 116. Another stabilizer cord (not shown) can be secured to loops 204, 206 and tightened/loosened to adjust the load being carried by sweatshirt 100. When not in use, the stabilizer cords can be stored in cord storage compartment 190.

An interior side of front panel 110 can include a plurality of loops 210 sewn therein between stabilizer material 126 and top 152 of front pocket assembly 140. Loops 210 are generally centered and extend along longitudinal axis A. An electronic device, such as a cell phone (not shown) can be inserted into one of inner pockets 160, 160' and cord 50, such as for headphones or earbuds (not shown), can pass through loops 210 and out neck opening 128. Further, head opening 129 can contain at least one opening 212 extending therethrough to allow for the passage of cord 50 out of sweatshirt 100. As shown in FIG. 1, two openings 212 are provided, one on either side of longitudinal axis A.

Figure 2A:
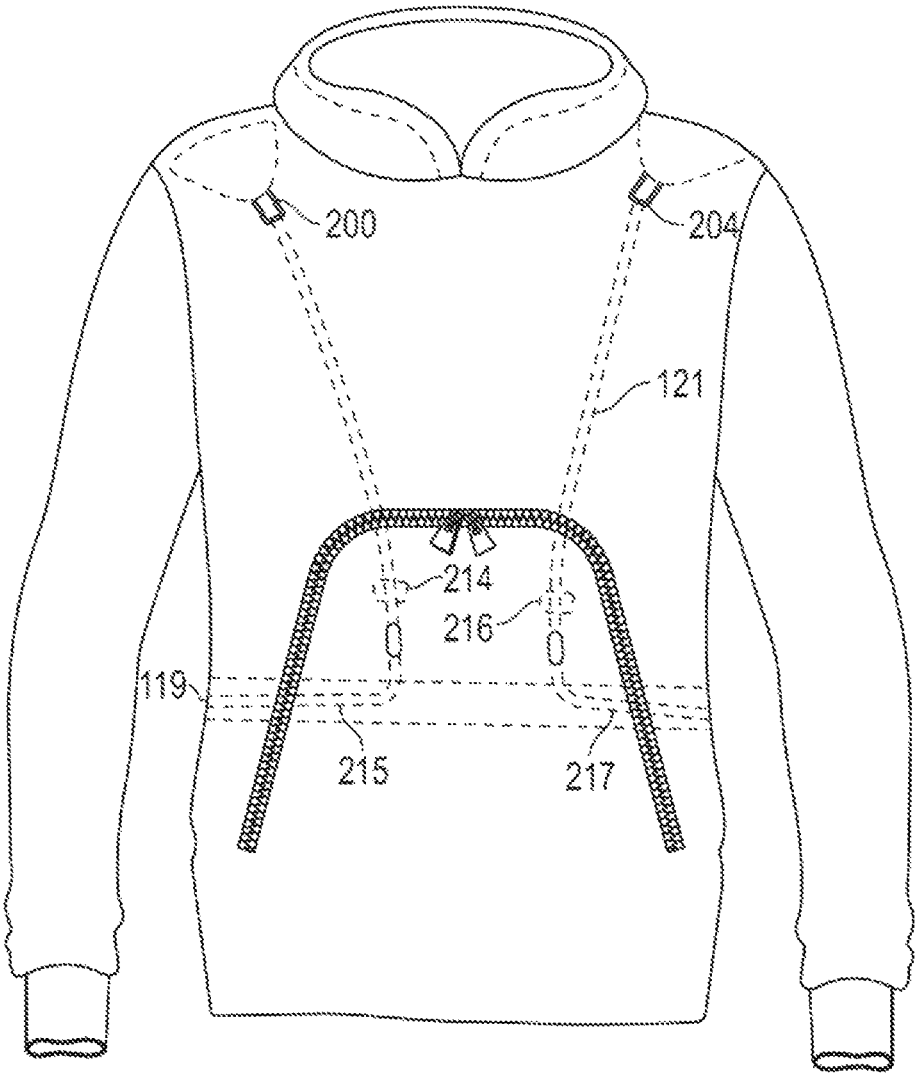
FIG. 2A is a front elevational view of a cargo carrying sweatshirt according to an alternative exemplary embodiment of the present invention.

Alternatively, as shown in FIG. 2A, slots 214, 215, 216, 217 can be provided inside front panel 110 through front panel 154 in front pocket assembly 140. Additionally, a horizontal sleeve 119 in communication with slots 215, 217 can extend all of the way around sweatshirt 100, generally at waist level. A stabilizer cord 121 can extend from loop 200, through slot 214 and outside of front panel 154, then back through slot 215 and into horizontal sleeve 119. Cord 121 can extend around the rear of the wearer to slot 217, out of slot 217, into slot 216, and connect to loop 204.

Figure 2B:
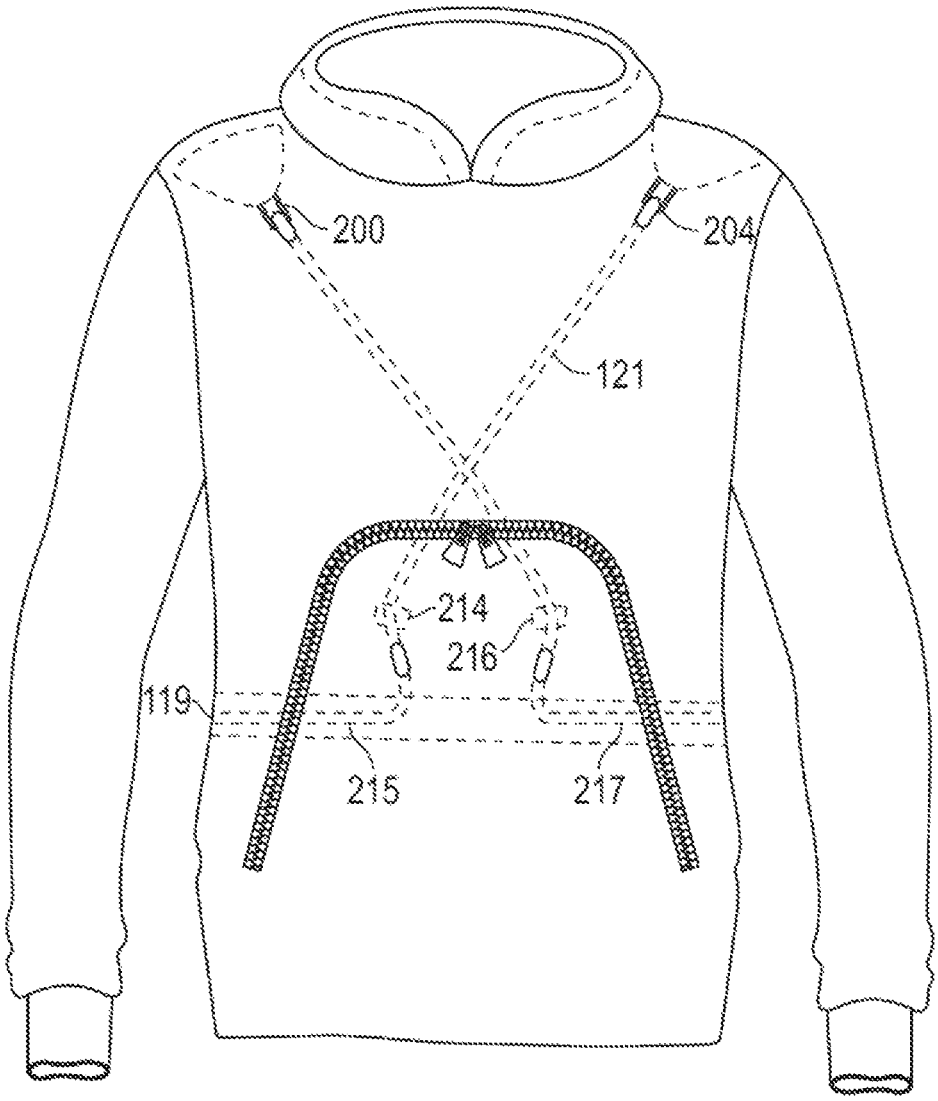
FIG. 2B is a front elevational view of a cargo carrying sweatshirt according to an alternative exemplary embodiment of the present invention.

Alternatively, as shown in FIG. 2B, cord 121 a extend from loop 202, through slots 217 and 217, through and around horizontal sleeve 119, through slots 215 and 214, and connect to loop 204 such that cord 121 criss-crosses above the wearer's waist.

In either embodiment of FIG. 2A or 2B, a wearer can adjust the length of cord 121 by providing known length adjustment mechanisms to extend outside of front pocket assembly 140 between slots 214 and 215, or slots 216 and 217, or both. The ability to adjust cord 121 allows the wearer to adjust the distribution of loads that are being carried by sweatshirt.

Each of left sleeve 118 and right sleeve 120 can include a sleeve pocket 220. Sleeve pocket 220 includes an outer pouch 222 having a side zipper 224 to open/close outer pouch 222 and an inner pouch 226 having a top hook and loop opening 228. The interior of front panel 110 and the interior of each sleeve 118, 120 can include a plurality of loops 230 sewn therein between stabilizer material 126 and sleeve pocket 220. An electronic device, such as a cell phone (not shown) can be inserted into one of sleeve pockets 220 and cord 50, such as for headphones or earbuds (not shown), can pass through loops 210 and out neck opening 128.

Figure 6:
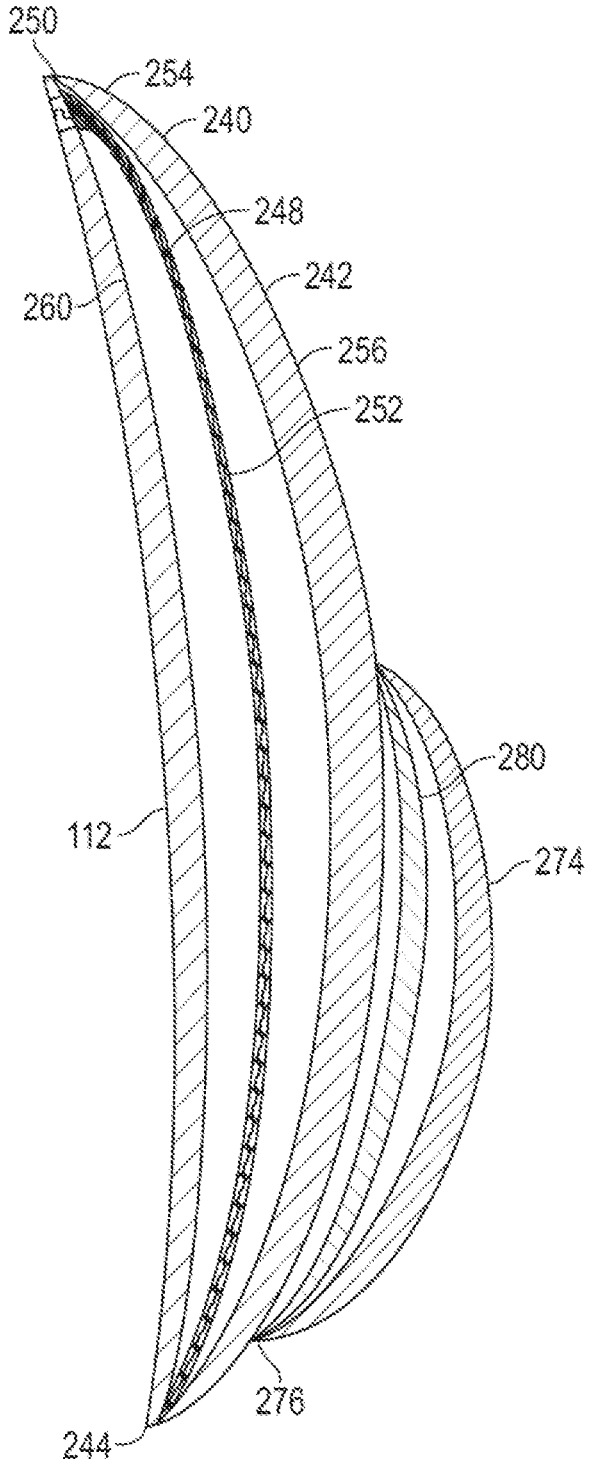
FIG. 6 is a sectional view of a rear pocket portion of the sweatshirt of FIG. 1, taken through lines 6-6 of FIG. 2.

Referring to FIGS. 2 and 6, rear panel 112 can include a rear pocket assembly 240. Rear pocket assembly 240 includes an upper pocket 242 having a closed bottom 244 and first and second zippered sides 246, 248. A zippered top 250 extends between first and second zippered sides 246, 248. A zipper 252 is operable to open and close any or all of first and second zippered sides 246, 248 and zippered top 250. While two zippers 252 are shown, those skilled in the art will recognize that a single zipper 252 can be used.

Rear pocket assembly 240 includes a front panel 254 having an exterior face 256. Front panel 254 is defined by closed bottom 244, first and second zippered sides 246, 248, and zippered top 250. A rear panel 260 is defined by closed bottom 244, first and second zippered sides 246, 248, and zippered top 250. Zipper 252 closes all of first and second zippered sides 246, 248 and zippered top 250, forming a closed pouch between front panel 254 and rear panel 260.

A lower pocket 274 extends below zippered top 250, with all of lower pocket 274 being mounted on front pocket assembly 240. Lower pocket 274 includes a closed bottom 276 that merges with front panel 254 of rear pocket assembly 240. Lower pocket 274 includes a right side opening 280 and a left side opening 282. Right and left side openings 280, 282 each extends between closed bottom 276 and closed top 278. Optionally, right and left side openings 280, 282 can each have a hook and loop closure to alternatively open/close lower pocket 274.

A cord storage compartment 290 extends across the front of rear panel 112 below lower pocket 274. Cord storage compartment 290 includes a zipper 292 to alternatively open/close cord storage compartment 290.

Rear panel 112 also includes a plurality of interior stabilizer loops 300, 302, 304, 306. Loop 300 is located at and connected to stabilizer material 126 on the right side of neck/shoulder area 124. Loop 302 is located just above body opening 129 proximate to right side panel 114. A stabilizer cord (not shown) can be secured to loops 300, 302 and tightened/loosened to adjust the load being carried by sweatshirt 100. Similarly, loop 304 is located at and connected to stabilizer material 126 on the left side of neck/shoulder area 124. Loop 306 is located just above body opening 129 proximate to left side panel 116. Another stabilizer cord (not shown) can be secured to loops 304, 306 and tightened/loosened to adjust the load being carried by sweatshirt 100. When not in use, the stabilizer cords can be stored in cord storage compartment 390.

Optionally, as shown in FIG. 3, instead of running stabilizer cords only along front loops 200-208 or rear loops 300-308, stabilizer cords 296, 298 can be run from upper front to lower back, as shown by stabilizer cord 296 extending between a front loop 204 and a rear loop 302 and a stabilizer cord 298 extending between a rear loop 300 and a front loop 206.

Rear panel 112 also includes exterior loops 310, 312 located below loops 300, 204. Additionally, a mesh pocket 314, 316 is located below rear pocket assembly 240, vertically in line with a respective loop 310, 312. Pockets 314 each have an open top 318, 320, respectively, so that an article, such as a baseball bat (not shown) can be inserted through one of loops 310, 312 and into a respective mesh pocket 314, 316 to that sweatshirt 100 can be used to carry the bat.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What I claim is:

1. A cargo-carrying sweatshirt comprising:

a front panel;

a rear panel;

a left panel connecting the front panel and the rear panel, the left panel having a left sleeve;

a right panel connecting the front panel and the rear panel, the right panel having a right sleeve;

a head opening at a top portion of the sweatshirt and defined by the front panel and the rear panel;

a body opening at a bottom portion of the sweatshirt and defined by the front panel, the rear panel, the left panel, and the right panel; and a longitudinal axis extending therethrough between the head opening and the body opening; and a front pocket assembly comprising:

an upper pocket having a closed bottom;

first and second zippered sides;

a zippered top extending between the first and second zippered sides;

a zipper operable to open and close any or all of the first and second zippered sides and the zippered top;

an upper pocket front panel having an exterior face and an opposing interior face, the upper pocket front panel being defined by the closed bottom, the first and second zippered sides, and the zippered top; and an upper pocket rear panel being defined by the closed bottom, the first and second zippered sides, and the zippered top, wherein, when the zipper closes all of the first and second zippered sides and the zippered top, a closed pouch is formed between the upper pocket front panel and the upper pocket rear panel;

an inner pocket having:

a closed bottom;

closed first and second sides;

a closable top extending between the first and second closed sides;

an inner pocket front panel formed from a portion of the interior face of the upper pocket front panel of the upper pocket, the inner pocket front panel being defined by the closed bottom, the closed first and second sides, and the closable top; and an inner pocket rear panel facing the upper pocket rear panel, the inner pocket rear panel being defined by the closed bottom, the closed first and second sides, and the closable top;

stabilizer material that extends 360 degrees around the head opening; and a plurality of first internal loops connected to the stabilizer material and a plurality of second internal loops proximate to the body opening, and a plurality of stabilizer straps, wherein each stabilizer strap is releasably securable to one of the first internal loops and one of the second internal loops.

2. The cargo carrying sweatshirt assembly according to claim 1, wherein the inner pocket comprises a first inner pocket extending at a first angle, oblique to the longitudinal axis and a second inner pocket extending at a second angle, oblique to the longitudinal axis.

3. The cargo carrying sweatshirt according to claim 1, further comprising an exterior loop attached to the rear panel proximate to the head opening and a pocket below the exterior loop proximate to the body opening, the exterior loop and the pocket being adapted to cooperate to receive and retain a baseball bat.

4. The cargo carrying sweatshirt according to claim 1, wherein the front panel further comprises a strap pocket extending between the closed bottom of the upper pocket and the body opening, wherein the strap pocket is sized to retain the plurality of stabilizer straps.

5. The cargo carrying sweatshirt according to claim 1, further comprising a plurality of internal loops extending between the head opening and the inner pocket.

6. The cargo carrying sweatshirt according to claim 5, further comprising a horizontal sleeve extending around the sweatshirt.

7. The cargo carrying sweatshirt according to claim 6, further comprising a slot in communication with the horizontal sleeve.

8. The cargo carrying sweatshirt according to claim 7, further comprising a slot located above the horizontal sleeve.

9. The cargo carrying sweatshirt according to claim 1, further comprising a sleeve pocket comprising an outer pouch and an inner pouch.

10. The cargo carrying sweatshirt according to claim 9, further comprising a plurality of internal loops extending between the head opening and the sleeve pocket.

11. The cargo carrying sweatshirt according to claim 1, further comprising a lower pocket extending below front pocket assembly.

12. The cargo carrying sweatshirt according to claim 11, wherein a portion of lower pocket is part of front pocket assembly.

* * * * *